US007503976B2

(12) United States Patent
Gilmore et al.

(10) Patent No.: US 7,503,976 B2
(45) **Date of Patent: *Mar. 17, 2009**

(54) COMPONENT IMPREGNATION

(75) Inventors: Christopher D. Gilmore, Shaker Heights, OH (US); Christopher B. Barney, Brooklyn, OH (US)

(73) Assignee: Godfrey & Wing, Inc.

( * ) Notice: Subject to any disclaimer, the term of this patent is extended or adjusted under 35 U.S.C. 154(b) by 561 days.

This patent is subject to a terminal disclaimer.

(21) Appl. No.: 11/020,852

(22) Filed: Dec. 22, 2004

(65) Prior Publication Data

US 2005/0160975 A1 Jul. 28, 2005

Related U.S. Application Data

(62) Division of application No. 10/292,346, filed on Nov. 12, 2002, now Pat. No. 6,913,650.

(51) Int. Cl.
*B05C 13/00* (2006.01)

(52) U.S. Cl. ..... 118/66; 118/52

(58) Field of Classification Search ..... 118/52, 118/66, 50, 423; 494/83
See application file for complete search history.

(56) References Cited

U.S. PATENT DOCUMENTS

| | | | | |
|---|---|---|---|---|
| 272,185 | A * | 2/1883 | Andersen et al. | 494/15 |
| 360,342 | A * | 3/1887 | Evans | 494/60 |
| 2,199,182 | A | 4/1940 | Leonard | |
| 3,599,946 | A | 8/1971 | Westeren et al. | |
| 3,701,676 | A | 10/1972 | Bader et al. | |
| 3,842,796 | A | 10/1974 | Hilditch et al. | |
| 3,863,838 | A * | 2/1975 | Pronk | 494/35 |
| 4,003,714 | A | 1/1977 | Foglino et al. | |
| 4,147,821 | A | 4/1979 | Young | |
| 4,196,231 | A | 4/1980 | Hubers | |
| 4,286,540 | A | 9/1981 | Bernath | |
| 4,311,735 | A | 1/1982 | Young | |
| 4,384,014 | A | 5/1983 | Young | |
| 4,464,848 | A | 8/1984 | Estberg | |
| 4,479,986 | A | 10/1984 | Juday | |
| 4,520,045 | A | 5/1985 | Kutsuna et al. | |
| 4,620,991 | A | 11/1986 | Young | |
| 4,722,295 | A | 2/1988 | Young | |
| 5,029,533 | A | 7/1991 | Hengelmolen | |
| 5,256,450 | A | 10/1993 | Catena | |
| 5,263,425 | A | 11/1993 | Koenig | |
| 5,288,521 | A | 2/1994 | Maldaner | |
| 5,416,159 | A | 5/1995 | Juday | |
| 6,176,934 | B1 | 1/2001 | Nelson | |
| 6,425,849 | B1 * | 7/2002 | Benson | 494/37 |

FOREIGN PATENT DOCUMENTS

FR 2 147 387 A 3/1973

* cited by examiner

*Primary Examiner*—Brenda A Lamb
(74) *Attorney, Agent, or Firm*—Tucker Ellis & West LLP

(57) ABSTRACT

A machine for impregnating a die cast metal part with liquid impregnant comprises an impregnation chamber having liquid impregnant in a lower portion, an opening for ingress and egress of the parts being defined in a side wall of the chamber above the liquid impregnant, a door for sealing the opening, a part holder in the chamber and an elevator for positioning parts above the liquid impregnant during evacuation of the chamber and then immersing the parts in the liquid impregnant during subsequent pressurization of the chamber.

4 Claims, 6 Drawing Sheets

COMPONENT IMPREGNATION

CROSS-REFERENCE TO RELATED APPLICATIONS

This application is a divisional of prior application Ser. No. 10/292,346, filed on Nov. 12, 2002.

BACKGROUND

The present invention relates to the Dry Vacuum/Pressure Process for impregnating parts and components with liquid impregnants.

In the Dry Vacuum/Pressure Impregnation Process, a part to be impregnated is placed in an impregnation chamber where a vacuum is drawn on the part. A liquid impregnant such as methyl methacrylate is then charged into the chamber, after which the vacuum is released to allow liquid impregnant into the part's micropores. The chamber is then pressurized to drive additional sealant into the micropores, after which the pressure is returned to atmospheric and the liquid impregnant withdrawn from the chamber to complete the impregnation process. After withdrawal from the chamber, excess sealant is removed from the part, and the part is then washed and heated to cure the sealant.

U.S. Pat. No. 4,479,986 to Juday describes technology for carrying out the Dry Vacuum/Pressure Impregnation Process in which the liquid impregnant is maintained in the impregnation chamber at all times, i.e., the liquid impregnant is not charged into and then withdrawn from the impregnation chamber during each impregnation cycle. A carrier is provided inside the impregnation chamber to support the parts being impregnated above the liquid impregnant while the vacuum is being drawn and then to lower the parts into the liquid impregnant for release of the vacuum and subsequent pressurization. One advantage of this approach, according to Juday, is shorter cycle times, since the time needed to charge and then discharge liquid impregnant is avoided.

However, the Juday technology is not used commercially, which is presumably due to the complex system needed to load, move and unload the parts into, within and out of the impregnation chamber. Thus, the Juday system uses a complicated transport assembly to lower and raise the parts to be impregnated into and out of the open top of Juday's impregnation chamber as well as to different positions inside this chamber during impregnation. In addition, this transport assembly also lowers and raises the cover used to close and seal the impregnation chamber. In addition, this transport assembly also spins the parts inside the chamber, since centrifuging the parts inside the impregnation chamber is an important feature of the Juday system. All of this complexity makes the Juday apparatus impractical from a commercial stand point.

For example, it is important for the automatic, trouble free operation of the Juday system that the parts in Juday's impregnation chamber accurately register with the conveyors and transport equipment used for loading and unloading these parts. In addition, it is also important that the cover which closes Juday's impregnation chamber accurately register with the open top of this chamber to insure a pressure-tight seal. Unfortunately, the many large, cumbersome, vertically-moving, structural elements that are part of Juday's transport assembly make accurate registration virtually impossible over time, because these elements are prone to wearing out because of their size, shape, weight, and complex movements.

Accordingly, it is an object of the present invention to provide new technology for impregnating parts with liquid impregnant by the Dry Vacuum/Pressure Impregnation Process using apparatus which avoids the large and cumbersome vertically moving structural elements of Juday's system while at the same time still allows the liquid impregnant to remain in the impregnation chamber for increased cycle time efficiency.

SUMMARY OF THE INVENTION

This and other objects are accomplished by the present invention, in accordance with which the parts to be impregnated are inserted into and withdrawn from the impregnation chamber through an opening in an upper side wall of the chamber. In addition, the elevator inside the chamber for lowering and raising the parts into and out of the liquid impregnant is remote from the door used to seal this opening. In addition, centrifuging of parts is done outside the impregnation chamber rather than inside. In a preferred embodiment, the parts to be impregnated are moved between successive work stations robotically.

With this approach, the inventive system is far simpler than Juday's system, since the complicated structure needed to move the parts between three different vertical positions, spin the parts inside the impregnation chamber and close the chamber cover is totally avoided.

Thus, the present invention provides an improved impregnation apparatus for impregnating die cast metal and other parts comprising an impregnation chamber having liquid impregnant in a lower portion thereof with the opening of the chamber being defined in a chamber side wall above the liquid impregnant, a door for sealing the opening, a part holder in the chamber and an elevator for positioning parts above the liquid impregnant during evacuation of the chamber and then immersing the parts in the liquid impregnant during subsequent pressurization of the chamber.

BRIEF DESCRIPTION OF THE DRAWINGS

The present invention may be more readily understood by reference to the following drawings wherein.

DETAILED DESCRIPTION

Figure 2:
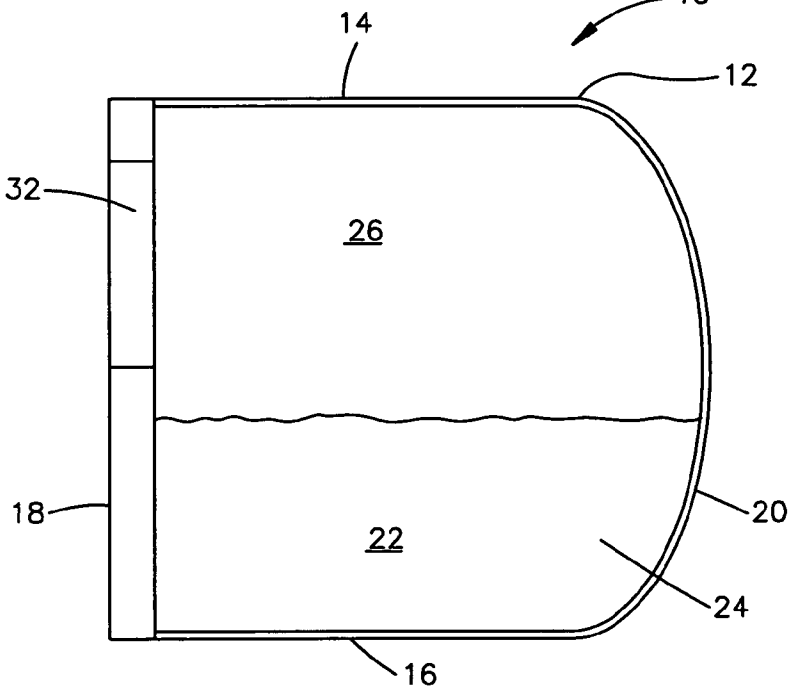
FIGS. 1 and 2 are schematic front and side views of the impregnation apparatus of the present invention.
Figure 1:
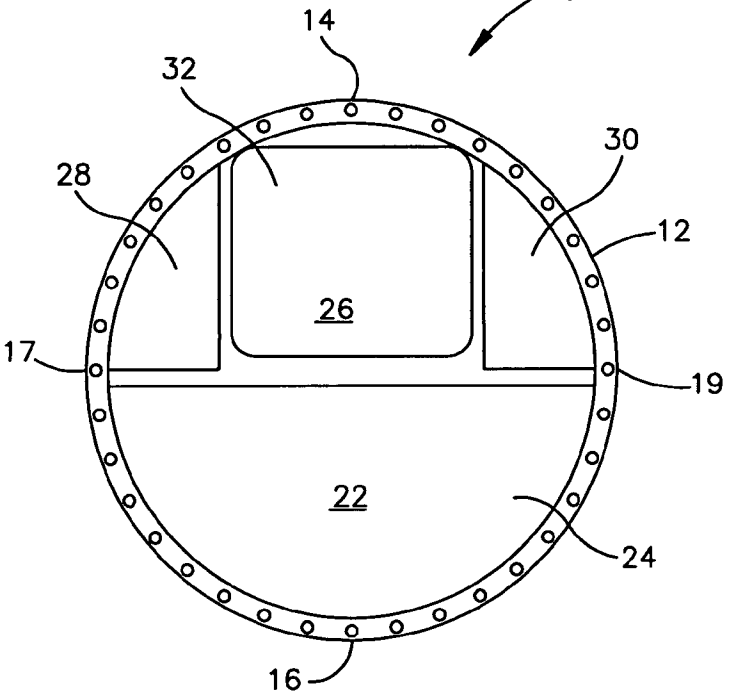

As shown in FIGS. 1 and 2, the impregnation apparatus of the present invention, which is generally indicated at 10, is composed of impregnation chamber 12 having a top 14, a bottom 16 and side walls 17, 18, 19 and 20 extending therebetween. In the particular embodiment shown, impregnation chamber 12 takes the form of a cylindrical barrel arranged so that the cylindrical axis of the barrel is essentially horizontal. In this configuration, side wall 18 is a flat, essentially vertical front wall of the barrel, while side wall 20 is a semi-hemispherical back wall of the barrel. Side walls 17 and 19, meanwhile, are each formed by a part of the cylindrical wall of the barrel. Impregnation chamber 12 can have any other configuration as desired such as a cube, sphere, rhomboid, etc., in which case the top, bottom and side walls of the chamber would vary accordingly. For example, in a chamber configured as a sphere, the top, bottom and side walls would each be formed from portions of the spherical wall of the sphere.

A liquid impregnant 22 such as methyl methacrylate is permanently maintained in a lower portion 24 of impregnation chamber 12. In this context, permanently maintained means that liquid impregnant is not removed from and then reinserted into the impregnation chamber between successive impregnation cycles of the apparatus. Above liquid impregnant 22 is an upper portion 26 of chamber 12 which includes a pair of baffles 28 and 30 for reducing the volume of air in chamber 12.

An opening or doorway 32 is formed in an upper portion of side wall 18 of the impregnation chamber for allowing ingress and egress of parts to be impregnated. As shown in FIG. 1, this opening communicates with upper portion 26 of chamber 12 and is located above liquid impregnant 22 in the chamber. In the particular embodiment shown, opening 32 is arranged in an essentially vertical orientation, since it is formed in side wall 18 which is also essentially vertical. In other embodiments of the invention, such as where impregnation chamber 12 is spherical, opening 32 can be arranged at an angle with respect to the vertical. In this context, the angle opening 32 makes with the vertical means the angle defined by a line drawn between the top and bottom of the opening and the vertical. Normally, opening 32 is arranged at an angle of no more than 45° with respect to the vertical, typically no more than 30°, more typically no more than 15°.

Figure 3:
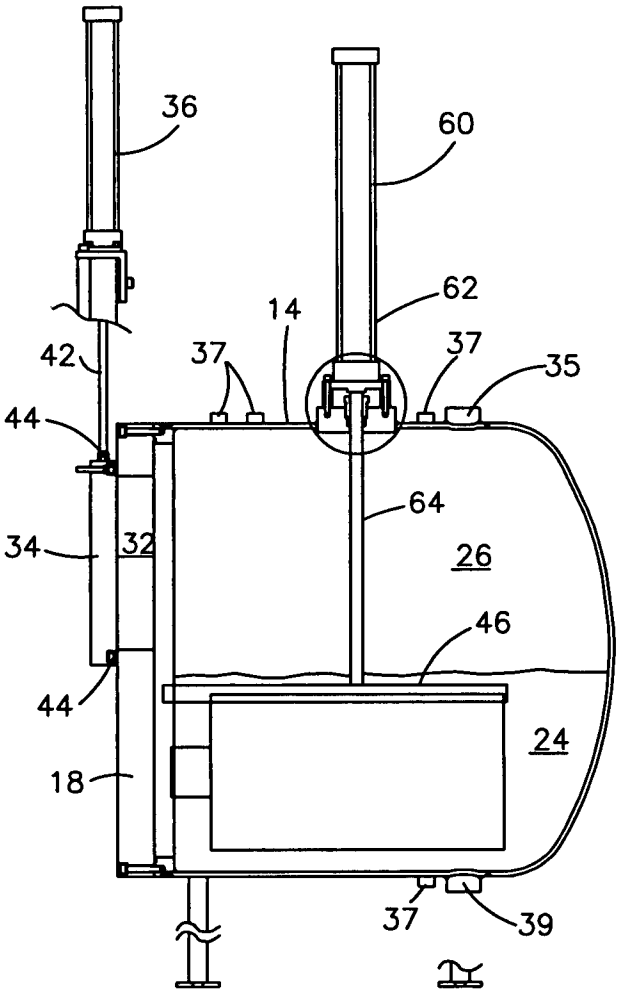
FIG. 3 is a side view similar to FIG. 2 showing the part holder and elevator used to move parts inside the impregnation apparatus of the invention as well as the structure of the door covering the chamber opening.
Figure 4:
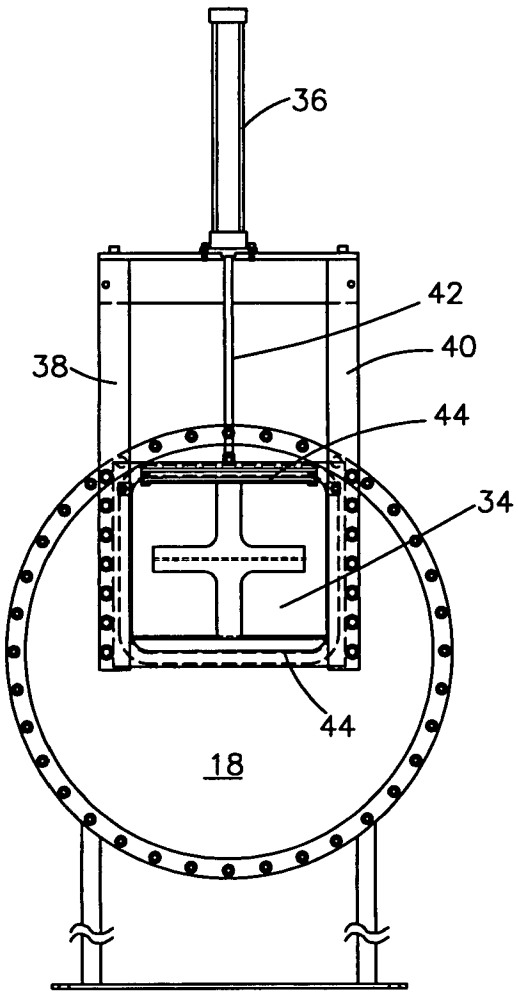
FIG. 4 is a front view similar to FIG. 1 showing the structure of the door used to seal the chamber opening.

Referring to FIGS. 3 and 4, door 34 is provided to close opening 32 during the impregnation process. In the particular embodiment shown, door piston 36 is provided to slidably move door 34 in rails 38 and 40 between its open and closed positions by means of piston rod 42. Inflatable seal 44 is provided to provide a strong, pressure-tight seal between door 34 and side wall 18 when door 34 is in its closed position during the impregnation process. Any other door/seal structure which will allow door 34 to repeatedly close and open while maintaining a good pressure-tight seal during impregnation can be used in lieu of the particular door/seal structure illustrated here. For example, side wall 18 and door 34 could be hemispherical or semi-hemispherical in configuration and/or door 34 could pivot on hinges rather than sliding on tracks or rails.

In order to allow connection to a pressure line [not shown] so that a vacuum as well as high pressure sufficient to carry out the Dry Vacuum/Pressure Impregnation Process can be imparted to chamber 12, pressure/vacuum port 35 is provided. Similarly, drain 39 is provided for supplying additional liquid impregnant into chamber 12. Analysis ports 37 are also provided for measuring various parameters inside chamber 12 such as liquid level and the like.

Figure 8:
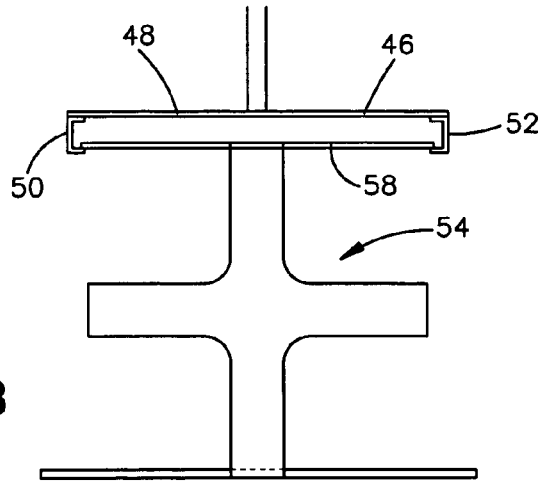
FIG. 8 is a schematic front view illustrating the part holder used in the apparatus of FIGS. 3 and 4 as well as an associated portable carrier for transporting a batch of parts to be impregnated.
Figure 9:
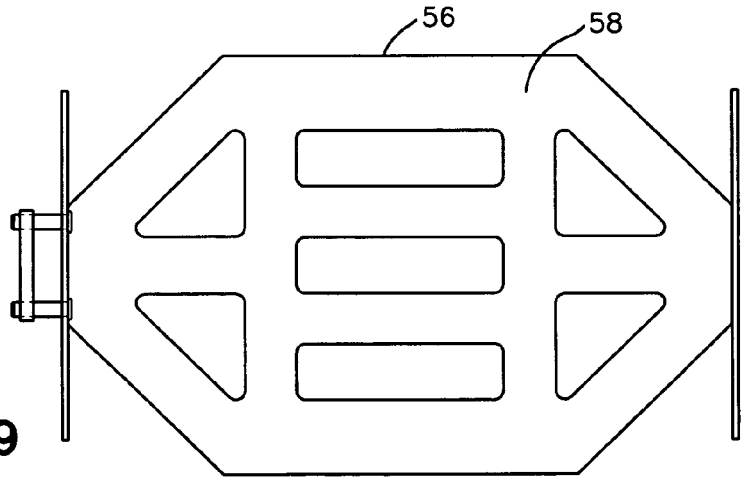
FIG. 9 is a plan view illustrating the top of the portable carrier of FIG. 8.

In order to support the parts to be impregnated while inside impregnation chamber 12 and to move these parts between upper portion 26 and lower portion 24 of the chamber, impregnation apparatus 10 is provided with part holder 46. As shown in FIG. 8, part holder 46 is composed in the particular embodiment shown of support rack 48 having a pair of laterally-extending U-shaped channels 50 and 52 on its sides. Part holder 46 is designed to remain inside chamber 12 during normal machine operation and to receive portable basket or carrier 54, which in turn is configured to receive and hold a part or batch of relatively small parts to be impregnated. As shown in FIGS. 8 and 9, the top 58 of portable carrier 54 is configured to be easily received in and supported by U-shaped channels 50 and 52 of part holder 46.

As further discussed below, the present invention in a preferred embodiment uses a robotic assembly for inserting and withdrawing parts to be impregnated into and out of impregnation chamber 12. For this purpose, part holder 46 and portable carrier 54 are designed to foster registration with one another as these structures are brought together. Thus, the front end 56 of the top 58 of carrier 54 is angled or pointed in configuration, while U-shaped channels 50 and 52 are large enough to allow some vertical leeway between top 58 and the sides of these channels. Accordingly, when carrier 54 is inserted into in upper portion 26 of impregnation chamber 12 though opening 32, the top 58 of carrier 54 will register with and be received by part holder 48 as the two slide together.

Part holder 46 can have any other structure which will allow it to receive and hold parts to be impregnated in the manner described here. For example, part holder 48 can be in the form of a tray or basket and/or can include its own gripping assembly for holding the part or parts to be impregnated.

In order to move part holder from upper portion 26 of impregnation chamber 12 to lower portion 24 (as shown in FIG. 3) elevator 60 is provided. In the particular embodiment shown, elevator 60 is composed of piston 62 which is attached or rigidly fixed with respect to top 14 of impregnation chamber 12. Piston 60 includes drive means or piston rod 64 which passes through top 14 and is attached to part holder 46. Elevator 60 can be any mechanical device which will raise and lower part holder 46. It can be a device mounted outside the chamber with an element passing through a top, side or bottom wall of the chamber for attachment to the part holder, such as piston, screw rod, chain drive, magnetic device or the like. Alternatively, it can be a device wholly inside the chamber which includes an electrical motor or other motive device actuated from inside or outside of the chamber.

As shown in FIG. 3, elevator 60 is remote from door 34. In other words, piston rod 64 does not drive the movement of door 34, directly or indirectly. Preferably, elevator 60 functions only to lift and lower part holder 46 and does not move the part holder in any other significant way, such as the rotary motion shown in the Juday patent. Note, also, that part holder 46 need only move between two vertical positions rather than three as in the Juday system, because it remains inside the chamber with parts being supplied through an opening in a chamber side wall. Because of these features, the inventive apparatus is simple in construction and hence avoids excessive part wear and hence registration and seal problems of the Juday technology discussed above.

Figure 5:
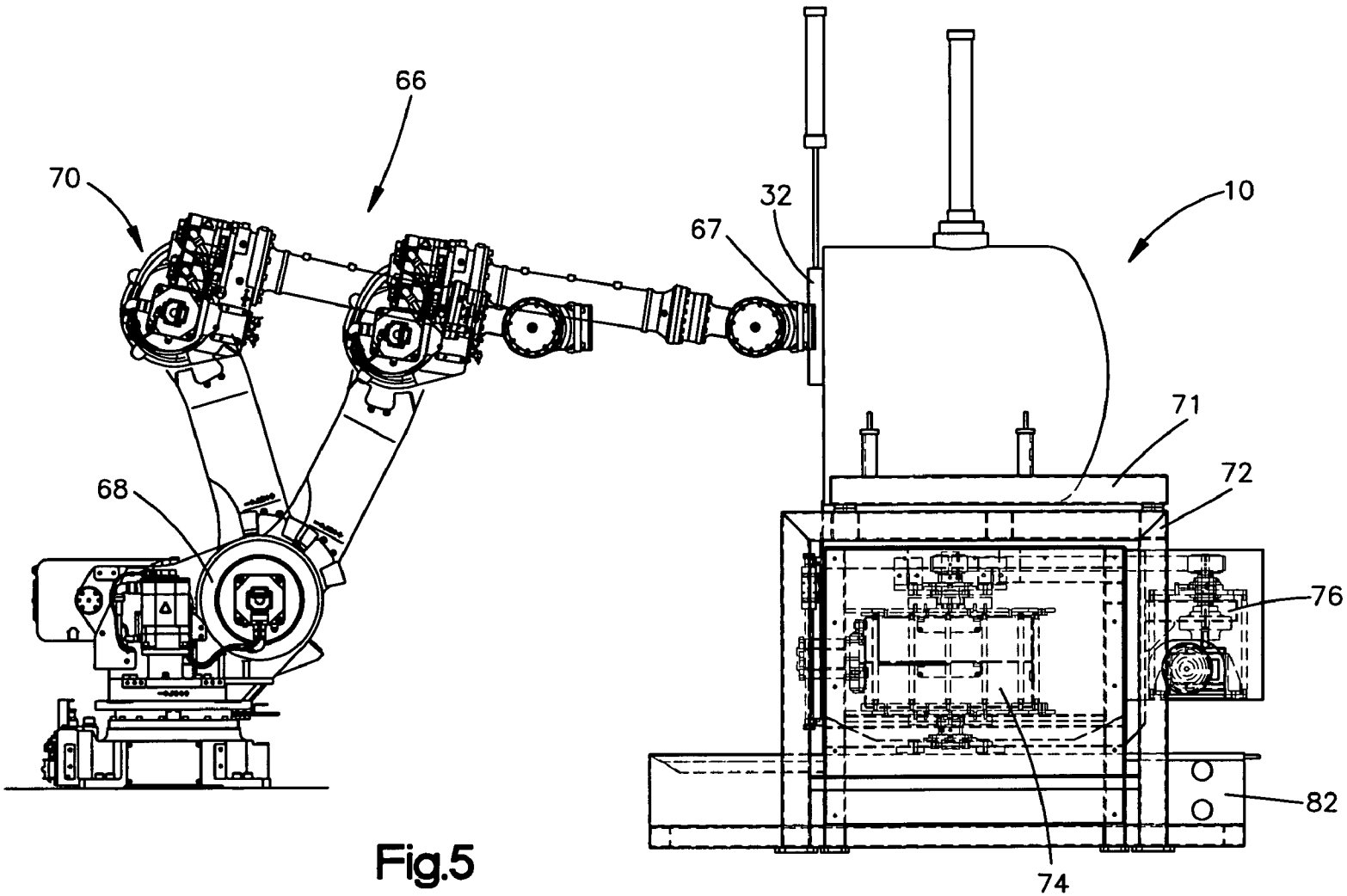
FIGS. 5 and 6 are side views illustrating the robot used in the preferred embodiment of the invention as it interacts with the impregnation apparatus (FIG. 5) and the centrifuging station (FIG. 6)

As indicated above, the inventive apparatus preferably uses robotics for inserting and withdrawing parts to be impregnated into and out of impregnation chamber 12. This is illustrated in FIG. 5, which shows robot 66 having robot arm 67 for inserting and withdrawing parts through opening or doorway 32 of impregnation chamber 12. Robot 66 includes a floor-mounted base 68 and a linkage mechanism 70 which causes robot arm 67 to move the parts to be impregnated through doorway 32 and into registration and contact with part holder 46.

In the particular embodiment shown, robot 66 moves the parts to be impregnated in an essentially horizontal direction as they move through doorway 32, as this facilitates sliding engagement and registration of carrier 54 and part holder 46. Robot 66, however, can be made to move the parts in other directions as they pass through doorway 32, especially where other structures are used for part holder 46 and carrier 54. For example, where opening or doorway 32 is arranged at an angle with respect to the vertical, it may be advantageous for robot 66 to move the parts in a direction essentially perpendicular to the opening. In any event it is desirable that the direction the parts are moved through opening 32 by robot 66 be no greater than about 45° with respect to horizontal, more typically no more than about 30° or even 15° with respect to horizontal. Of course, once the parts are inside impregnation chamber 12, robot 66 can lower these parts to engage part holder 46, if necessary.

Figure 6:
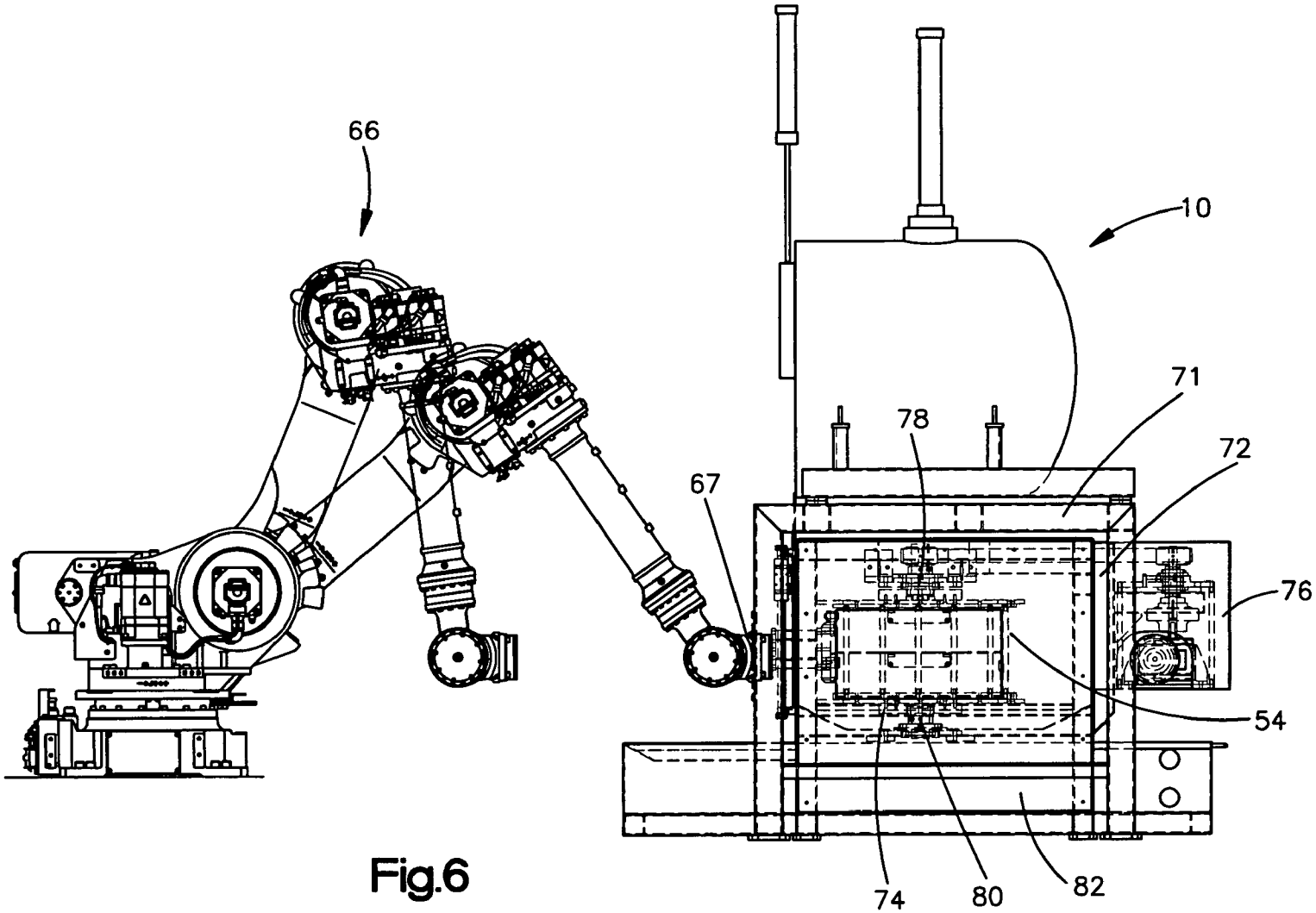

Once impregnation is complete, the impregnated parts may be mechanically processed to remove excess liquid impregnant from their surfaces. One way this can be done is illustrated in FIG. 6, which shows a centrifuge 74 located between the legs of table 72 on top of which impregnation apparatus 10 is mounted. Removing excess liquid impregnant by centrifuging is already known. A typical centrifuge used for this purpose includes a basket or carrier with an open top into which the part or parts to be centrifuged are deposited. A rotatable shaft mounted in a bearing supports the basket for rotation, which is typically driven by motor connected to the shaft through a V-belt or gearing.

Such centrifuges are normally operated at maximum speeds on the order of 100 rpm. Even at these speeds, the bearings can wear out rapidly and the shaft, bearings and shaft/basket connections can rapidly fail. The problem only becomes worse when the part or parts to be centrifuged are unevenly distributed due to the inherent wobble created. Furthermore, when die cast and other porous metal parts are centrifuged at these relatively low rotational speeds, only about 50% of the liquid impregnant on the part surfaces is removed for recovery and reuse. The remaining 50% is lost in the subsequent washing process. Since only about 1% if the liquid impregnant present on a part after impregnation is actually within its micropores, this washing loss represents a considerable expense.

Figure 10:
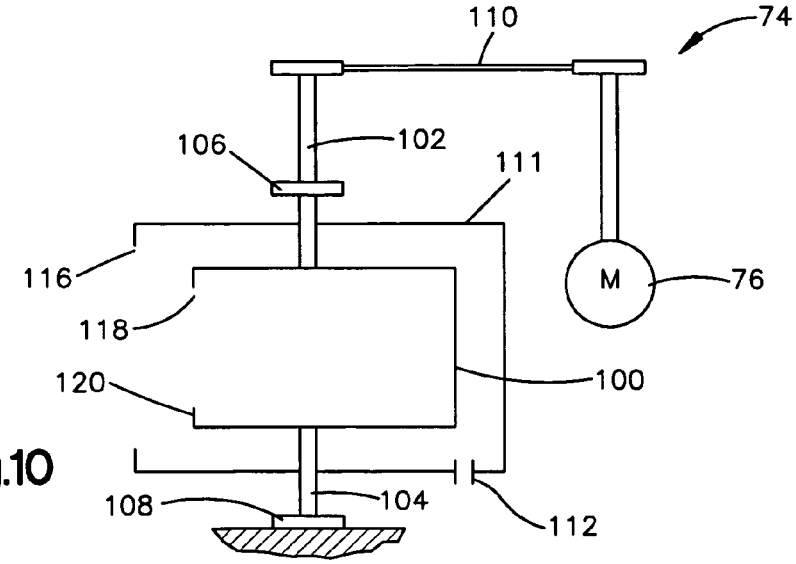
FIG. 10 is a schematic illustration of the centrifuge used in accordance with another preferred embodiment of the present invention.

In a preferred embodiment of the present invention, a centrifuge as illustrated in FIGS. 6 and 10 is used to remove excess liquid impregnant on the part surfaces. As shown in these figures, centrifuge 74 takes the form of a centrifuge carrier 100 which is mounted in its approximate center to an upper support shaft 102 and a lower support shaft 104. Shafts 102 and 104, in turn, are mounted for rotation in bearings 106 and 108. Motor 76 is provided to drive centrifuge carrier 100 through V-belt 110. Housing 111 is provided to catch excess liquid sealant which is spun off the parts being centrifuged, while drain 112 in housing 111 (FIG. 10) allows liquid sealant collected in the bottom of the housing to flow by gravity to catch basin 82 (FIG. 5). An automatic liquid level control system (not shown) is provided to keep a constant level of liquid impregnant in impregnation chamber 12 by replacing lost impregnant from catch basin 82. A second automatic liquid level control system (also not shown) is provided to keep a constant level of liquid impregnant in catch basin 82.

Housing 111 includes housing doorway 116 and a door (not shown), while centrifuge carrier 100 defines on open side 118, which is defined at its bottom by lip 120. With this structure, a part or parts to be centrifuged, normally in carrier 54, can be conveniently inserted into centrifuge carrier 100 by robot 66 in the manner shown in FIG. 6. Thereafter, housing 110 is closed by its door and centrifuge carrier 100 rotated by motor 76. Lip 120 keeps the part or parts form sliding off centrifuge carrier 100, even if they are not evenly distributed about its center of rotation. Moreover, because centrifuge carrier is support from above and below by two rotating shafts, it can be rotated much faster than conventional centrifuges without risk of excessive wobble, wear or destruction. For example, centrifuge 74 can conveniently be operated at speeds of as much as 200 rpm, 225 rpm or even 250 rpm. At such high rotational speeds, much more liquid impregnant is spun off the part surfaces and recovered than when conventional centrifuges are used. For example, 60, 65, 70% or more of the total amount of liquid impregnant on and in the parts (and carrier) can be recovered, which is considerably more than the 50% maximum possible with conventional centrifuges. This represents a considerable savings over conventional practice. Of course, lower centrifuging speeds such as 175 rpm or more, or even 150 rpm or more can also be used.

Figure 7:
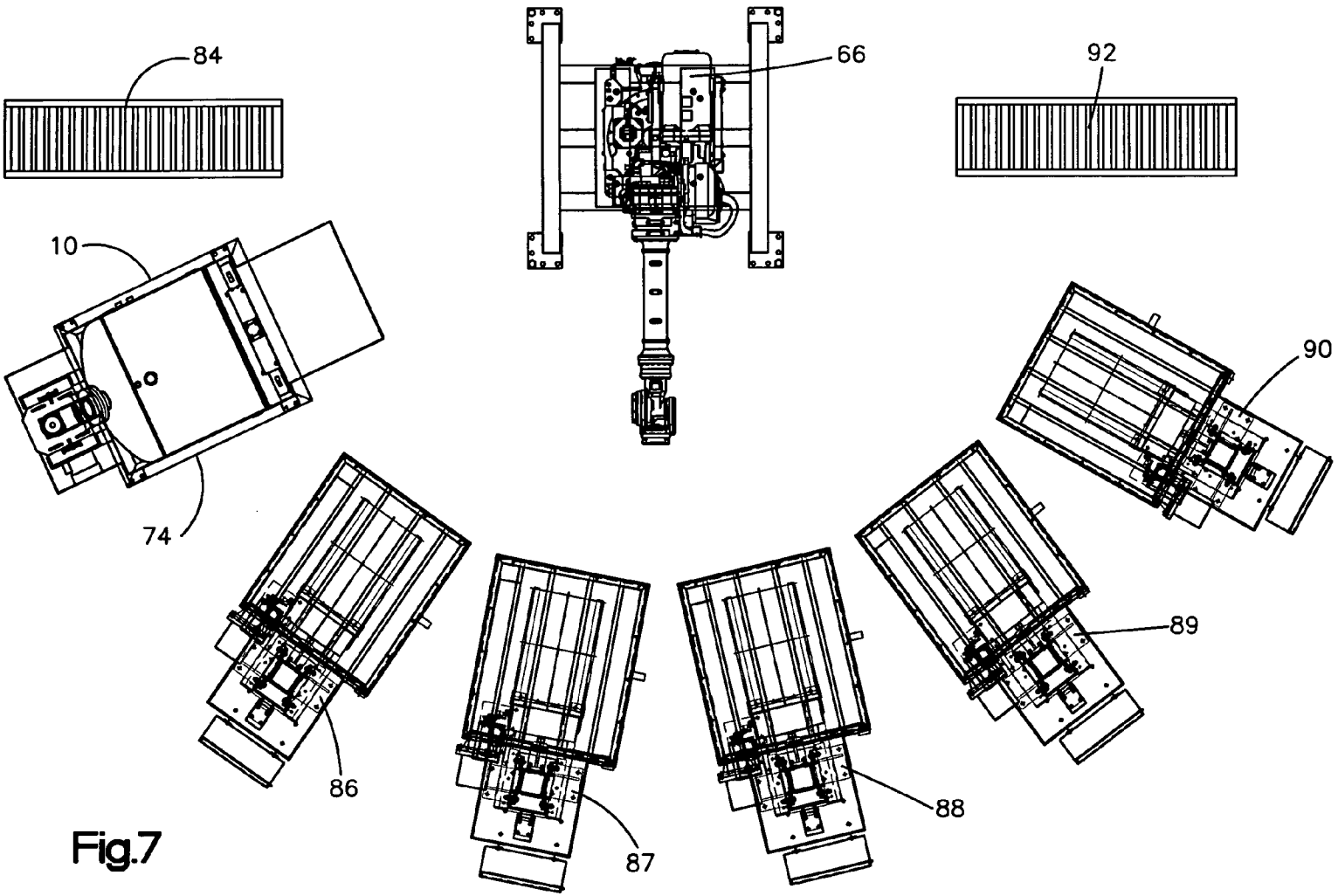
FIG. 7 is a plan view illustrating the arrangement of the different work stations of the inventive assembly in relation to the robot in a preferred embodiment of the present invention.

The operation of the inventive impregnation apparatus of FIGS. 1 to 5 is illustrated in FIGS. 6 and 7, as well as FIG. 5. As illustrated in FIG. 7, impregnation apparatus 10 and centrifuge 74 are positioned adjacent to supply conveyors 84 for supplying parts to be impregnated. In addition, washing station 86 is provided to wash the centrifuged parts, while curing stations 87, 88, 89 and 90 are provided to cure the liquid impregnant still remaining in the impregnated parts. Washing can be done in a conventional manner, such as by using water or other aqueous cleaning liquid maintained at room temperature, for example.

In the particular embodiment shown, the parts to be washed are repeatedly dipped into and then withdrawn from a volume of water wash in a lower portion of washing station 86. In addition, the parts are repeatedly rotated back and forth about a horizontal axis above the carrier in which they are contained, i.e., carrier 54, to impart further relative motion between the parts and the water. In addition, air is sparged into the water volume to impart still additional turbulence and mixing to this water volume. Finally, additional water wash is sprayed onto the parts when they are above the surface of the water volume. This combination of features insures effective removal of surface liquid impregnant rapidly and efficiently.

Curing in curing stations 87, 88, 89 and 90 may also be done in a conventional manner such as, for example, by immersion in water maintained at or near the cure temperature of the particular liquid impregnant used, which is typically near boiling (i.e. about 195° F.) in the case of methyl methacrylate and similar liquid polymer sealants used for sealing die cast metal parts. Because curing sealants may take longer than a complete impregnation cycle, four separate curing stations are provided in the particular embodiment shown in FIG. 7, these stations being intended for use on sequential parts.

Any number of curing stations can be used, however, depending on the time it takes to effect curing of the particular liquid impregnant being used in the particular part being impregnated. For example, some liquid impregnants cure at ambient temperatures, while other liquid impregnants don't cure at all. In these cases, no curing stations are needed. In other situations, curing can be effected in the same period of time as impregnation-centrifuging-washing, in which case only one curing station is needed. It will therefore be appreciated that any number of curing stations, such as one, two, three, four, five or more, including no curing stations, can be provided as desired.

Once curing is completed, the fully cured parts are removed from curing stations 87, 88, 89 and 90 and transferred to storage. In the particular embodiment illustrated in FIG. 7, this is done by robot 66 transferring the parts from the curing stations to discharge conveyor 92. Any other means for conveying parts to storage and/or delivery can, of course, be used.

As illustrated in FIG. 7, impregnation apparatus 10, centrifuging station 74, wash station 86, curing stations 87, 88, 89 and 90 and the proximal ends of conveyors 84 and 92 are all arranged in a semi-circle around robot 66. This allows robot 66 to transfer parts from supply conveyor 84, to and between successive work stations, and then to discharge these parts to conveyor 92 quickly, accurately and automatically.

In operation, a part or batch parts normally carried in carrier or basket 54 is captured by robot arm 67 of robot 66 from the proximal end of a supply conveyor 84 (FIG. 7) and then inserted into upper portion 26 of impregnation apparatus 10 (FIG. 3). After transferring the carrier to part holder 46, the robot arm is withdrawn and door 34 slid shut by door piston 36. Inflatable seal 44 is then actuated to provide a vacuum and pressure tight seal within chamber 12. The interior of chamber 12 is then evacuated through pressure port 35 to carry out the vacuum step of the process, with the parts being maintained above and out of contact with the liquid impregnant maintained in lower portion 24 of the chamber. After this step is complete, elevator 60 lowers the parts until they are submerged (preferably completely) in the liquid impregnant, after which the vacuum in chamber 12 is released so that the pressure returns to atmospheric. As a result, liquid impregnant is driven into the part micropores by the increase in pressure in chamber 12 relative to the pressure in these micropores. After the pressure in chamber 12 returns to approximately atmospheric, an additional pressure (e.g. 50 to 150, more typically 80 to 120 psi) is imparted to chamber 12 to drive further amounts of liquid impregnant into the micropores. The pressure in chamber 12 is then released, the parts raised back to upper portion 26 of impregnation chamber 12, and door 34 opened to complete the impregnation process.

Robot arm 67 then captures and withdraws carrier 54 from chamber 12 through opening 32 and then moves carrier 54 to centrifuge 74. See FIG. 6. Here, the parts are centrifuged after which they are moved by robot arm 67 to wash station 86. Once washing is complete, the washed parts are transferred by robot arm 67 to curing station 87 where the liquid impregnant in the micropores is cured. After curing is complete, the cured parts and carrier 54 are removed from curing station 87 and transferred to conveyor 92 for transfer to storage and delivery. Any water remaining on the parts flash evaporates as soon as they are withdrawn from the curing station because of their high temperature. Additional parts are processed in the same way, except that successive parts or batches of parts are charged in order into curing stations 88, 89 and 90, respectively, to allow each part to enjoy a residence time in its curing station approximately four times its residence time in the other work stations.

As indicated above, the inventive assembly is capable of successively impregnating multiple parts as well as multiple batches of parts quickly, accurately and automatically. Because robot 66 can transfer parts between successive work stations rapidly and accurately, only a small increment of time is lost each time a part or batch of parts is transferred from one work station to another. The result is that successive parts or batches of parts can be processed at the same time in successive work stations with little time being lost between the processing of successive parts or batches of parts in each work station. This, in turn, results in the overall efficiency of the process being significantly enhanced. Moreover, because parts are supplied to impregnation apparatus 10 through an opening in an upper portion of a side wall, and further because the door covering this opening and the elevator raising and lowering the parts inside the apparatus operate independently of one another, wear and reliability problems such as associated with the Juday apparatus are avoided.

Additional advantages of the present invention especially as illustrated in FIG. 7 are its modular design, its compact "footprint" and its automatic operation. Die cast metal parts such as engine blocks are typically impregnation sealed by separate job shops remote from the factories in which parts are cast and used. This is because the impregnation equipment in commercial use today is large, antiquated and cumbersome, the procedures used are still as much an art as a science, the process is very labor intensive, and a lot of floor space is required. Therefore, major industrial manufactures prefer to have this work done by contractors rather than internally. The inventive impregnation assembly overcomes these disadvantages, since the individual work stations are small and simple in design and hence easily reproducible and relatively inexpensive. In addition, these work stations are easily automated, thereby drastically reducing labor requirements. Finally, these work stations can be arranged in close proximity to one another, as shown in FIG. 7, thereby saving floor space.

The present invention is ideally suited for impregnating die cast metal parts with liquid polymer sealants such as methyl methacrylate. However, it can also be used to impregnate any other porous component including composite material parts, molded plastic parts, parts formed by powdered metallurgy techniques, wood parts, carbon composite parts, other cast metal and plastic parts, and the like. Furthermore, any liquid impregnant which is or becomes known for impregnating such parts can be used in the present invention. For example, other polymer sealants in addition to methyl methacrylate can be used to seal die cast metal parts and other parts needing sealing. In addition, liquid preservatives and the like can be used to impregnate wood and other similar components. In this connection, curing stations 87, 88, 89 and 90 need not be employed when impregnants used are not intended to be sealed. Also, washing station 86 need not be employed when removing surface impregnant is unnecessary.

Although only a few embodiments of the present invention are described above, it should be appreciated that many modifications can be made without departing from the spirit and scope of the invention. All such modifications are intended to be included within the scope of the present invention, which is to be limited only by the following claims.

We claim:

1. An assembly for successively impregnating multiple parts or batches of parts with liquid impregnant, the assembly including (a) impregnation apparatus for impregnating a part with liquid impregnant, the impregnation apparatus comprising an impregnation chamber having a top, a bottom and at least one side wall therebetween, the chamber defining a lower portion for receiving a liquid impregnant and an upper portion above the lower portion, a side wall of the chamber defining an opening communicating with the upper portion of the chamber, the opening being above the liquid impregnant in the chamber during impregnation, a door for sealing the opening during evacuation and subsequent pressurization of the chamber for impregnation of the part, a part holder in the chamber for receiving the part to be impregnated, and an elevator for positioning the part holder in the upper portion of the chamber so that the part is held above the liquid impregnant during evacuation of the chamber and then for positioning the part holder in the lower portion of the chamber so that the part is immersed in the liquid impregnant during subsequent pressurization of the chamber, and (b) a centrifuging station for removing excess liquid impregnant off the parts after removal from the impregnation chamber, the centrifuging station being located below the impregnation chamber, wherein the centrifuging station comprises a centrifuge having a centrifuge carrier for carrying the part or parts to be centrifuged, the centrifuge carrier being mounted for rotation about a vertical axis by means of a first bearing above the centrifuge carrier and a second bearing below the centrifuge carrier, wherein the centrifuge is further comprised of housing which surrounds the centrifuge carrier and the housing having a top and bottom wall and a door in its sidewall which closes a housing opening and wherein the centrifuge carrier is further comprised of a top and bottom wall and an opening in a side wall which is defined by a bottom lip and wherein the parts are fed through the housing opening and into the side wall opening of the centrifuge carrier and the parts are prevented from sliding off the centrifuge carrier during centrifugation by the bottom lip.

2. The assembly of claim 1, wherein the centrifuging station is adapted to rotate the parts at a rate of at least about 200 rpm.

3. The assembly of claim 1, wherein the assembly includes a washing station for washing the surfaces of the part after centrifuging and a curing station for curing the liquid impregnant inside the part.

4. The assembly of claim 3, wherein the assembly includes multiple curing stations.

* * * * *